US009068698B2

(12) United States Patent
Park et al.

(10) Patent No.: US 9,068,698 B2
(45) Date of Patent: Jun. 30, 2015

(54) APPARATUS AND METHOD FOR PROCESSING LEAKING CARBON DIOXIDE

(71) Applicant: KOREA INSTITUTE OF GEOSCIENCE AND MINERAL RESOURCES, Daejeon (KR)

(72) Inventors: Jongmyung Park, Daejeon (KR); Dae Gee Huh, Dajeon (KR)

(73) Assignee: KOREA INSTITUTE OF GEOSCIENCE AND MINERAL RESOURCES, Daejeon (KR)

( * ) Notice: Subject to any disclaimer, the term of this patent is extended or adjusted under 35 U.S.C. 154(b) by 0 days.

(21) Appl. No.: 14/479,507

(22) Filed: Sep. 8, 2014

(65) Prior Publication Data

US 2015/0068615 A1 Mar. 12, 2015

(30) Foreign Application Priority Data

Sep. 10, 2013 (KR) ..... 10-2013-0108204

(51) Int. Cl.
*F17D 5/02* (2006.01)
*F17D 1/02* (2006.01)

(52) U.S. Cl.
CPC ..... *F17D 1/02* (2013.01); *F17C 2260/037* (2013.01); *Y10T 137/5762* (2015.04); *F17D 5/02* (2013.01)

(58) Field of Classification Search
None
See application file for complete search history.

(56) References Cited

U.S. PATENT DOCUMENTS 6,498,898 B2 * 12/2002 Schmitt ..... 392/466
7,357,144 B2 * 4/2008 Im et al. ..... 137/15.04

FOREIGN PATENT DOCUMENTS

| | | |
|---|---|---|
| JP | 2005-201444 | 7/2005 |
| JP | 2005-214685 | 8/2005 |
| KR | 20-1993-0001496 | 1/1993 |
| KR | 100849399 | 7/2008 |

OTHER PUBLICATIONS

Korean Office Action dated Nov. 21, 2013.

* cited by examiner

*Primary Examiner* — Duane Smith
*Assistant Examiner* — Phillip Shao
(74) *Attorney, Agent, or Firm* — Justin H. Kim; Maxon IP LLC

(57) ABSTRACT

Disclosed herein is an apparatus for processing leaking carbon dioxide, which is provided to a transfer line composed of pipes connected from a carbon dioxide generation facility to a carbon dioxide reservoir to process the leakage of carbon dioxide, including: a box-shaped shield case provided to cover a connection part of the pipes constituting the transfer line to prevent carbon dioxide leaking from the connection part from diffusing; and a bypasser bypassing the carbon dioxide into the shield case to the outside of the shield and storing this carbon dioxide. The apparatus is advantageous in that the diffusion of the carbon dioxide leaking from the connection part of the transfer line is blocked by the shield case, and simultaneously is supplied to the collection tank and stored therein by the bypasser, thereby preventing the leaking carbon dioxide from diffusing.

10 Claims, 4 Drawing Sheets

APPARATUS AND METHOD FOR PROCESSING LEAKING CARBON DIOXIDE

This application claims foreing priority benefits under 35 U.S.C. §119 and 172 of Korea Patent Application No. 10-2013-0108204, filed on Sep. 10, 2013, which is incorporated by reference in its entirety into this application.

BACKGROUND

1. Technical Field

The present invention relates to an apparatus and method for processing leaking carbon dioxide. More particularly, the present invention relates to an apparatus for processing leaking carbon dioxide, wherein carbon dioxide, which may leak from a transfer line for transferring carbon dioxide for storage in the sea or under the ground, particularly, from the connection part of the transfer line, is collected and processed to prevent the diffusion of leaking carbon dioxide, and to a method for processing leaking carbon dioxide using the same.

2. Description of the Related Art

Global warming, currently becoming serious, causes abnormal weather as well as disturbs ecosystems. Therefore, global warming has attracted common attention all over the world, and efforts to reduce or solve global warming have been made in various fields.

The greenhouse effect attributable to carbon dioxide is pointed out as a cause of accelerating global warming, and carbon capture and storage (CCS), which is a technology for capturing and storing a large amount of carbon dioxide, is receiving considerable attention as an effort to reduce the discharge of carbon dioxide to the atmosphere.

Here, CCS was proposed in order to cope with the changes in climate and the demand for the reduction of greenhouse gas according to the Kyoto Protocol, and is referred to as a technology including the processes of: capturing a large amount of carbon dioxide generated from a large scale installations such as a thermoelectric power plant, a steel plant, a cement factory or the like; compressing the captured carbon dioxide to make liquefied or supercritical carbon dioxide; transferring the liquefied or supercritical carbon dioxide to a waste ocean oil field, a waste ocean gas field, a waste coal field, a deep saline aquifer or the like by a pipe line or a ship or the like to semi-permanently store and control this carbon dioxide.

For example, the storage of carbon dioxide is conducted by injecting carbon dioxide into a porous rock layer (sandstone bed or the like) located at a distance of 800 m or less from the bottom of a sea to fill the pores thereof (gaps between sediment particles: 10~30 vol %) with the carbon dioxide.

Recently, an undersea carbon dioxide reservoir capable of permanently isolating and storing five billion tons of carbon dioxide was discovered in the continental shelf of the southwestern sea area of the Uleung Basin in Korea. Accordingly, it is predicted that an undersea carbon dioxide reservoir for storing one million tons of carbon oxide will be commercially developed.

According to the CCS, carbon dioxide is transferred from a carbon dioxide generation facility to a carbon dioxide reservoir through transfer lines serially connected from the facility to the reservoir, and is then stored in the reservoir.

However, since the transfer lines are serially connected and installed pipe lines, there is a problem that carbon dioxide may leak from the connection parts of pipes.

Here, examining the influence of carbon dioxide on the human body, it is known that, upon exposure to carbon dioxide, a person feels unpleasant, his or her pulse rate and respiration rate increase, and a symptom such as dizziness or headache occurs when the concentration of carbon dioxide in the air is 1000~2000 ppm (0.1~0.2%). Further, it is known that a person may die due to the difficulty in breathing when the concentration of carbon dioxide in the air is 10% or more.

Therefore, when carbon oxide leaks from transfer lines in large amounts, there is a problem that the humans may be injured and ecosystems may be damaged. Particularly, when carbon dioxide leaks around a densely populated area, there is a problem that the humans may be injured, and social disorder may occur.

SUMMARY OF THE DISCLOSURE

Accordingly, the present invention has been devised to solve the above-mentioned problems, and an object of the present invention is to provide an apparatus and method for processing leaking carbon dioxide, wherein carbon dioxide, which may leak from a transfer line composed of pipes, particularly, from the connection part of the pipes, is bypassed to the outside of the connection part to prevent the leaked carbon dioxide from diffusing into the air.

Another object of the present invention is to provide an apparatus and method for processing leaking carbon dioxide, wherein carbon dioxide leaking from the connection part of pipes is bypassed with being dissolved in a fluid, separated from the fluid by a separator, and then collected in a collection tank.

In order to accomplish the above object, an aspect of the present invention provides an apparatus for processing leaking carbon dioxide, which is provided to a transfer line composed of pipes continuously connected from a carbon dioxide generation facility to a carbon dioxide reservoir to process the leakage of carbon dioxide, including: a box-shaped shield case provided to cover a connection part of the pipes constituting the transfer line to prevent carbon dioxide leaking from the connection part from diffusing; and a bypasser bypassing the carbon dioxide into the shield case to the outside of the shield and storing this carbon dioxide.

Here, the bypasser may include: a collection tank connected with the shield case to collect the carbon dioxide discharged from the shield case; a fluid circulation unit connecting the collection tank with the shield case and circulating a fluid between the collection tank and the shield case to supply the carbon dioxide stored in the shield case to the collection tank with the carbon dioxide dissolved in a fluid; and a separator separating carbon dioxide from the fluid supplied to the collection tank.

The fluid circulation unit may include: a fluid supply pipe connecting the collection tank with the shield case to supply the fluid from the collection tank to the shield case; a fluid discharge pipe connecting the collection tank with the shield case to discharge the fluid from the shield case to the collection tank; and a circulation pump providing negative pressure to the fluid supply pipe or the fluid discharge pipe to circulate the fluid.

Further, the fluid circulation unit further may include a leak detection sensor installed in the shield case to detect the concentration of carbon dioxide in the shield case and operate the circulation pump depending on the detected concentration of carbon dioxide.

The separator may be a heater installed in the collection tank to heat the fluid supplied to the collection tank and separate carbon dioxide dissolved in the fluid.

The bypasser may further include a discharge unit discharging the carbon dioxide separated from the fluid and collected in the collection tank.

The discharge unit may include: a concentration sensor detecting the concentration of carbon dioxide in the collection tank and generating a control signal when the detected concentration reaches a set value; and a discharge valve opening and closing the collection tank according to the control signal of the concentration sensor to discharge carbon oxide to the outside of the collection tank.

Unlike this, the discharge unit may include a relief valve opening and closing the collection tank according to an increase in internal pressure of the collection tank to discharge carbon oxide to the outside of the collection tank.

Further, the bypasser may further include a secondary collection tank covering the collection tank to collect the carbon oxide discharged through the discharge unit.

Another aspect of the present invention provides method of processing carbon oxide leaking from a transfer line composed of pipes connected by a connection part, including the steps of: covering the connection part to prevent the diffusion of carbon dioxide leaking from the connection part; and bypassing the carbon oxide and storing this carbon dioxide in a collection tank with the collection tank being spaced apart from the connection part.

Here, the step of bypassing carbon dioxide may include the steps of: detecting carbon dioxide; supplying a fluid to the detected carbon dioxide and circulating this fluid to bypass the carbon dioxide dissolved in the fluid; and separating carbon dioxide from the carbon dioxide-dissolved fluid.

In the step of separating the carbon dioxide, the carbon dioxide may be separated from the fluid by heating the fluid.

As described above, according to the apparatus and method for processing leaking carbon dioxide, the diffusion of the carbon dioxide leaking from the connection part of the transfer line is blocked by the shield case, and, simultaneously, the leaking carbon dioxide is supplied to the collection tank and stored therein by the bypasser, thereby preventing the leaking carbon dioxide from diffusing into the air.

Further, the carbon dioxide leaking into the shield case is supplied to the collection tank by the fluid circulation unit with being dissolved in a fluid, and then carbon dioxide is separated from the fluid by a separator and collected in the collection tank, and thus this carbon dioxide in the shield case is stably bypassed to be collected in the collection tank.

Specifically, since the fluid is circulated through the fluid supply pipe and the fluid discharge pipe by the negative pressure of the circulation pump, the carbon dioxide in the shield case can be easily supplied to the collection tank. Further, the fluid is heated by the heater, and thus carbon dioxide is separated from the fluid, and the separated carbon dioxide is collected in the collection tank.

Further, since the circulation pump is operated by the leak detection sensor for detecting the leakage of carbon dioxide, it is operated only when carbon dioxide leaks from the connection part, thus reducing the consumption of energy.

Further, since the collection tank is provided with the discharge unit, carbon dioxide can be discharged from the collection tank to the air, and thus the internal pressure of the collection tank can be controlled.

For example, when the discharge unit is composed of the concentration sensor and the discharge valve opened and closed by the control signal of the concentration sensor, the pressure of carbon oxide in the collection tank can be electrically controlled. Unlike this, when the discharge unit is composed of only the relief valve, the pressure of carbon oxide in the collection tank can only be mechanically controlled.

Moreover, since the collection tank is covered by the secondary collection tank, the carbon dioxide discharged through the discharge unit does not leak into the air.

BRIEF DESCRIPTION OF THE DRAWINGS

The above and other objects, features and advantages of the present invention will be more clearly understood from the following detailed description taken in conjunction with the accompanying drawings, in which.

REFERENCE NUMERALS

Figure 1:
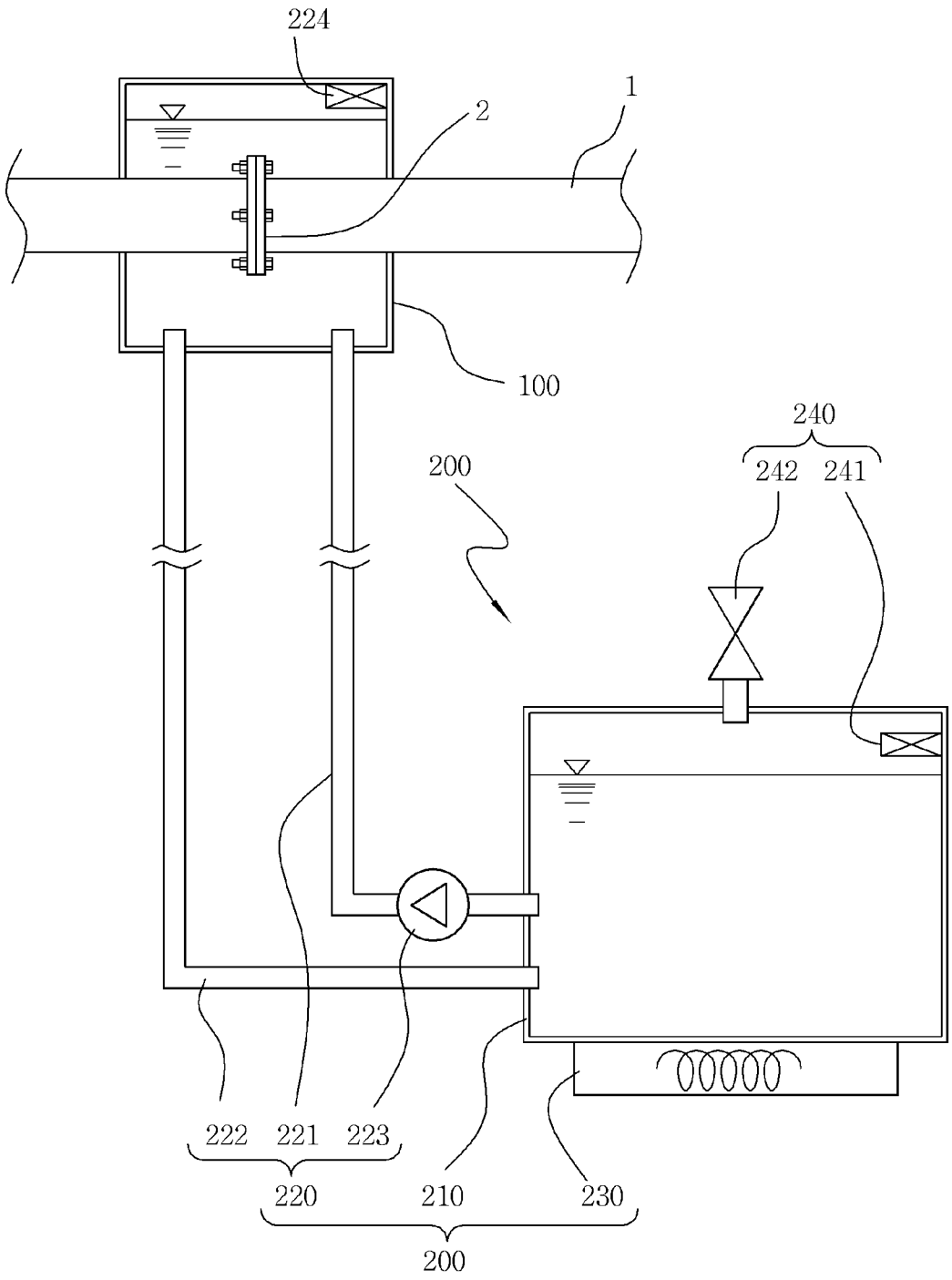
FIG. 1 is a sectional view showing an apparatus for processing leaking carbon dioxide according to the present invention.

1: transfer line
2: connection part
100: shield case
200: bypasser
210: collection tank
220: fluid circulation unit
221: fluid supply pipe
222: fluid discharge pipe
223: circulation pump
224: leak detection sensor
230: separator
240: discharge unit
241: concentration sensor
242: discharge valve
250: secondary collection tank

DETAILED DESCRIPTION

Hereinafter, preferred embodiments of the present invention will be described in detail with reference to the attached drawings. In the description of the present invention, when it is determined that the detailed description of the related art would obscure the gist of the present invention, the description thereof will be omitted.

As shown in FIG. 1, the apparatus for processing leaking carbon dioxide according to an embodiment of the present invention includes a shield case 100 and a bypasser 200.

The shield case 100 is used in preventing the diffusion of carbon dioxide leaking from a connection part 2 of pipes constituting a transfer line 1. As shown in FIG. 1, the shield case 100 is a box-shaped case, and serves to cover the outside of the connection part 2 while being penetrated by the transfer line 1.

That is, the shield case 100 covers the outside of the connection part 2 to primarily store carbon dioxide leaking from the connection part 2.

Figure 3:
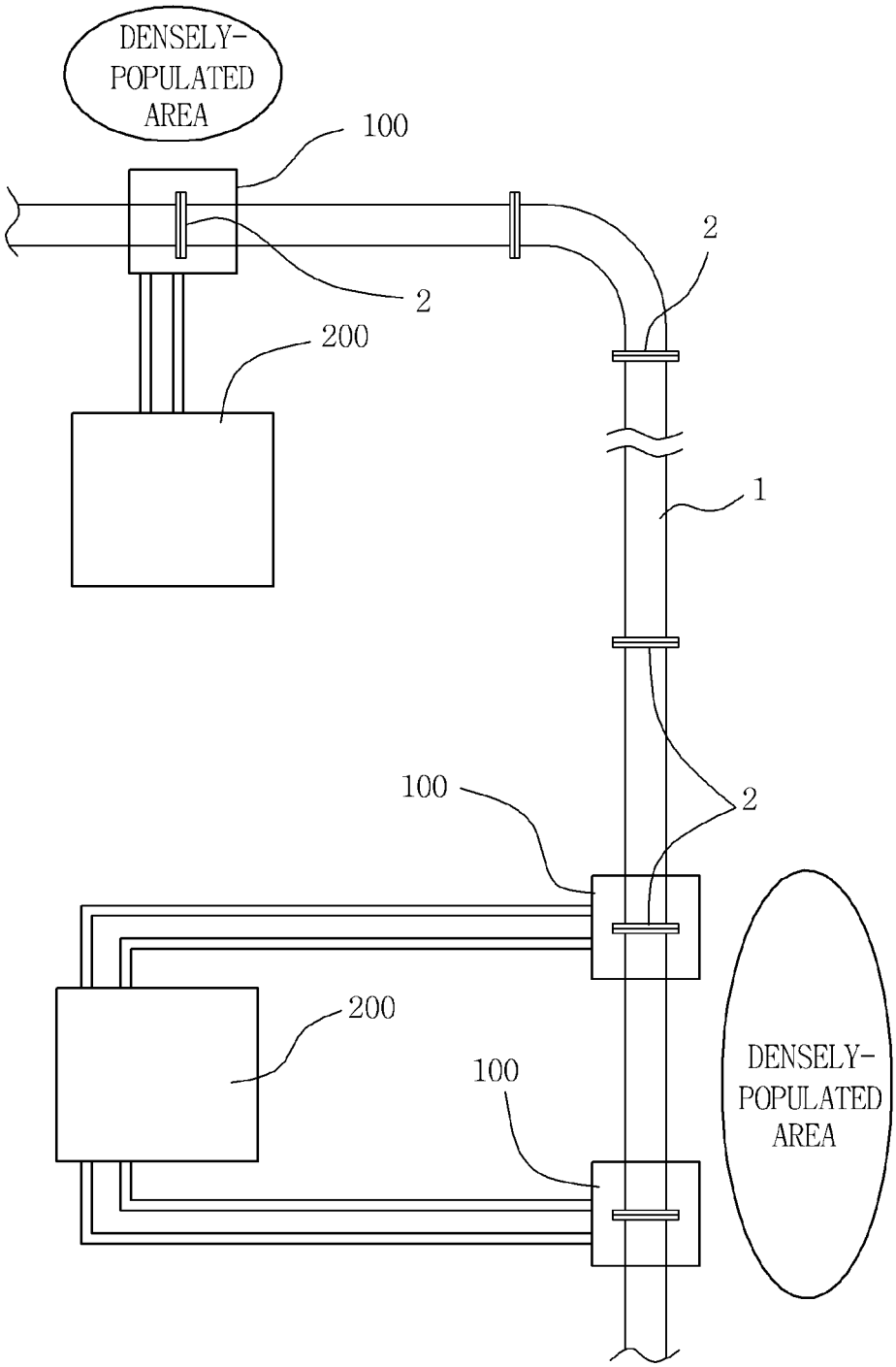
FIG. 3 is a schematic view showing the usage state of the apparatus for processing leaking carbon dioxide according to the present invention.

It is preferred that, as shown in FIG. 3, this shield case 100 be disposed to cover the connection part 2 located in a densely-populated area or adjacent thereto, among the connection parts 2 constituting the transfer line 1.

The reason for this is that, when carbon dioxide leaks in an isolated area, the area can be restored without great damage, but, when carbon dioxide leaks in a densely-populated area, humans may be injured and social disorder may occur.

The bypasser 200 serves to bypass the carbon dioxide primarily stored in the shield case 100 to the outside of the shield case 100 and store this carbon dioxide in a collection tank 210.

That is, as shown in FIG. 3, the bypasser 200 serves to bypass the carbon dioxide leaking from the connection part 2 located in a densely-populated area to a safe area away from the densely-populated area and store this carbon dioxide in the safe area.

For example, the bypasser 200, as shown in FIG. 1, may include a collection tank 210, a fluid circulation unit 220 and a separator 230

Here, the collection tank 210 is disposed in a safe area with being spaced apart from the shield case 100, and is connected to the shield case 100 by the following fluid circulation unit 220 to secondarily store the carbon dioxide discharged from the shield case 100.

The fluid circulation unit 220 serves to supply the carbon dioxide stored in the shield case 100 to the collection tank 210 with the carbon dioxide dissolved in a fluid by connecting the collection tank 210 with the shield case 100 and circulating the fluid.

For example, the fluid circulation unit 220, as shown in FIG. 1, may include a fluid supply pipe 221, a fluid discharge pipe 222 and a circulation pump 223.

The fluid supply pipe 221 connects the collection tank 210 with the shield case 100 to supply the fluid stored in the collection tank 210 to the shield case 100.

The fluid discharge pipe 222, as shown in FIG. 1, is disposed in parallel with the fluid supply pipe to discharge the fluid supplied to the shield case 100 to the collection tank 210.

The circulation pump 223, as shown in FIG. 1, is installed in the fluid supply pipe 221 or the fluid discharge pipe 220 to circulate the fluid using the suction force caused by the formation of negative pressure.

Here, the fluid may be water, and, preferably, may be charged in both the collection tank 210 and the shield case 100. It is known that carbon dioxide is easily dissolved in water compared to oxygen.

In conclusion, carbon dioxide leaks from the connection part 2 of the transfer line 1, and is simultaneously dissolved in the fluid charged in the shield case 100. The carbon dioxide-dissolved fluid is supplied from the shield case 100 to the collection tank 210 through the fluid discharge pipe 222 by the negative pressure of the circulation pump 223. Then, carbon dioxide is separated from this fluid by the following separator 230 to be collected in the collection tank 210.

Then, the carbon dioxide-separated fluid is supplied to the shield case 100 through the fluid supply pipe 221 by the negative pressure of the circulation pump 223.

Meanwhile, the above-mentioned fluid circulation unit 220 may further include a leak detection sensor 224.

The leak detection sensor 224 serves to detect the leakage of carbon dioxide to operate the circulation pump 223. For example, as shown in FIG. 1, the leak detection sensor 224 is installed in the shield case 100, and operates the circulation pump 223 depending on the concentration of carbon dioxide. That is, the leak detection sensor 224 may be configured as a concentration sensor.

Specifically, the leak detection sensor 224 measures the concentration of carbon dioxide in the shield case 100, determines that carbon dioxide leaks when the measured concentration reaches a set value, and then applies a control signal to the circulation pump 223 to circulate the fluid, thus bypassing the leaking carbon dioxide to the collection tank 210.

Therefore, the circulation pump 223 is operated only when carbon dioxide leaks from the connection part 2.

Here, the leak detection sensor 224 may be configured as a pressure sensor for detecting the pressure change in the shield case 100 or a sensing probe for detecting the leakage of carbon dioxide using infrared rays or ultrasonic waves instead of the above-mentioned concentration sensor.

That is, the configuration of the leak detection sensor 224 is not limited as long as it detects the leakage of carbon dioxide to generate a control signal for operating the circulation pump 223.

The separator 230 serves to separate carbon dioxide from the fluid supplied to the collection tank 210 by the operation of the circulation pump 223.

For example, the separator 230 may be configured as a heater for heating the fluid supplied to the collection tank 210 to separate carbon dioxide from the fluid.

Such a heater, as shown in FIG. 1, may heat the fluid from the outside of the collection tank 210, and, unlike FIG. 1, may also heat the fluid in the collection tank 210.

That is, carbon dioxide is supplied to the collection tank 210 with it dissolved in a fluid, and then the carbon dioxide-dissolved fluid is heated to high temperature to separate carbon dioxide from this fluid. The separated carbon dioxide is collected in the collection tank 210.

Meanwhile, the bypasser 200 of the present invention, as shown in FIG. 1, may further include a discharge unit 240.

The discharge unit 240 serves to discharge the carbon dioxide separated by the separator 230 and collected in the collection tank 210 to the outside. For example, the discharge unit 240, as shown in FIG. 1, may include a concentration sensor 241 and a discharge valve 242.

As shown in FIG. 1, the concentration sensor is installed in the collection tank 210 to detect the concentration of carbon dioxide, and generates a control signal when the detected concentration reaches a set value.

The discharge valve 242 is installed at the top of the collection tank 210 to open and close the collection tank 210, and is opened according to the control signal of the concentration sensor 241 to discharge carbon oxide from the collection tank 210 to the outside.

For example, this discharge valve 241 may be configured as a solenoid valve for opening and closing the collection tank 210 according to the control signal of the concentration sensor 214.

Unlike this, the discharge unit 240 may include a relief valve instead of the discharge valve 242 when the concentration sensor 241 is not used.

The relief valve is installed at the top of the collection tank 210 to open and close the collection tank 210, and is opened according to the increase in internal pressure of the collection tank to discharge carbon oxide to the outside.

That is, the discharge unit 240 may be composed of the concentration sensor 241 and the discharge valve 242 to electrically discharge carbon dioxide from the collection tank 210, or may be composed of only the relief valve to mechanically discharge carbon dioxide from the collection tank 210.

Here, the discharge unit 240 does not influence humans because carbon dioxide is discharged from the collection tank 210 in a safe area, and prevents the increase in the internal pressure of the collection tank 210.

Figure 2:
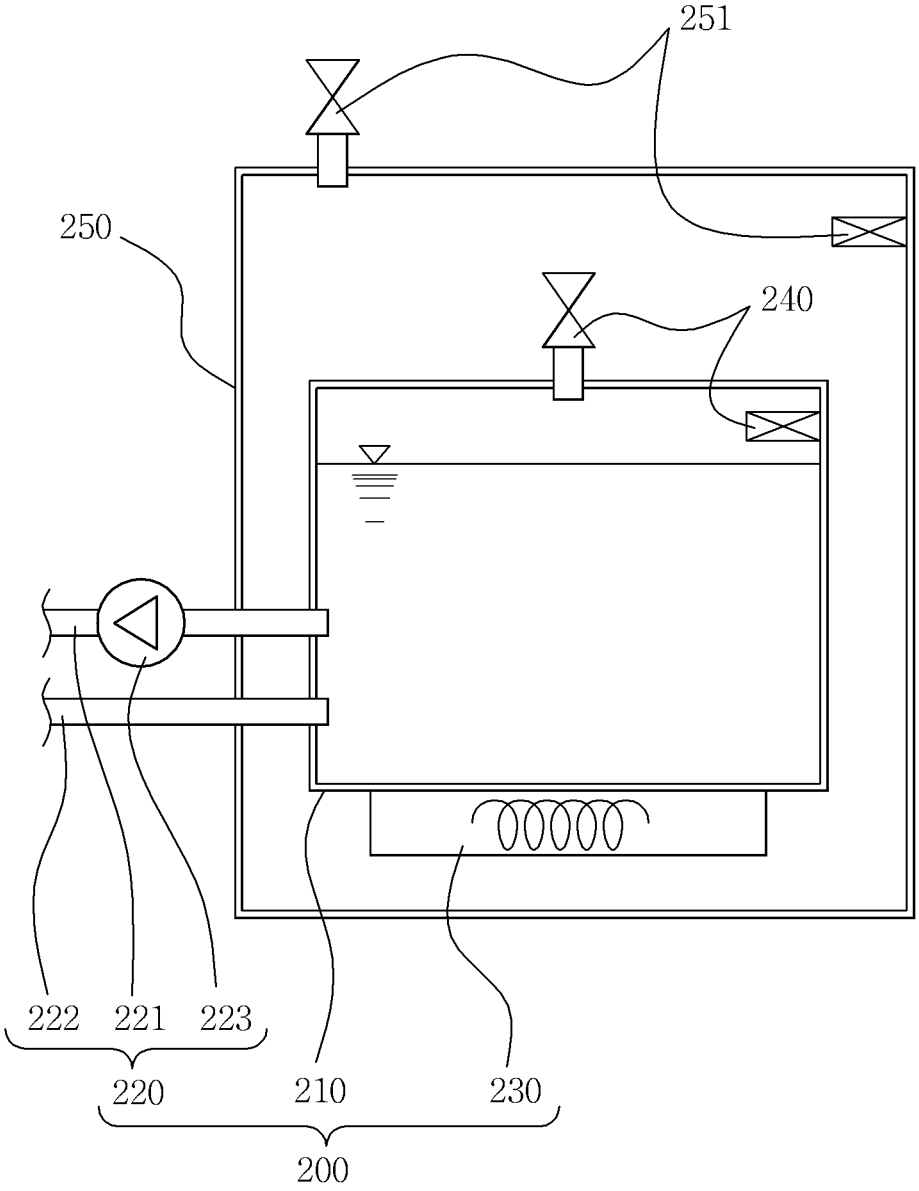
FIG. 2 is a longitudinal section view showing the structure of a bypasser according to the present invention.

Meanwhile, as shown in FIG. 2, the bypasser 200 of the present invention may further include a secondary collection tank 250.

As shown in FIG. 2, the secondary collection tank 250 covers the collection tank 210 to collect the carbon oxide discharged through the discharge unit 240, thereby preventing the leakage of carbon dioxide to the air.

The secondary collection tank 250 is provided with a secondary discharge unit 251 having the same structure as that of the discharge unit 240 to control the internal pressure thereof.

Figure 4:
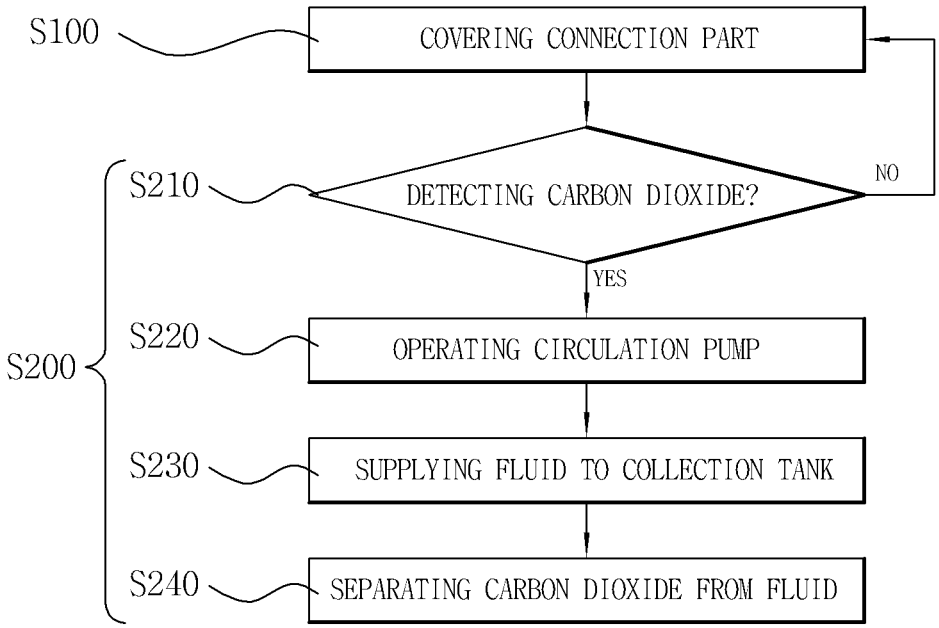
FIG. 4 is a block diagram showing a method for processing leaking carbon dioxide according to the present invention.

Hereinafter, a method for processing leaking carbon dioxide using the apparatus according to the present invention will be described in detail with reference to FIG. 4.

The shield case blocks carbon dioxide leaking from the connection part to prevent the leaking carbon dioxide from diffusing into the air (S100).

The bypasser 200 bypasses the carbon oxide leaking into the shield case 100 to the collection tank 210 located in a safe area and spaced apart from the connection part 2 to store this carbon dioxide in the collection tank 210 (S200).

In this case, the leak detection sensor 224 detects the leakage of carbon dioxide through the concentration or pressure of carbon hydroxide in the shield case 100 to generate a control signal (S210), and the circulation pump 223 is operated by the leak detection sensor 224 to circulate a fluid between the shield case 100 and the collection tank 210 (S220).

Thus, the carbon dioxide leaking from the connection part 2 is supplied to the collection tank 210 through the fluid discharge pipe 222 with it dissolved in a fluid (S230). Then, the carbon dioxide-dissolved fluid is heated by a heater constituting the separator 230 to separate carbon dioxide from this fluid, and the separated carbon dioxide is collected in the collection tank 210 (S240).

Here, the carbon dioxide collected in the collection tank 210 is discharged into the air through the discharge unit 240 located in a safe area, or is stored in the secondary collection tank 250.

As described above, according to the present invention, the diffusion of the carbon dioxide leaking from the connection part 2 of the transfer line 1 is blocked by the shield case 100, and, simultaneously, the leaking carbon dioxide is supplied to the collection tank 210 and stored therein by the bypasser 200, thereby preventing the leaking carbon dioxide from diffusing into the air.

Further, the carbon dioxide leaking into the shield case 100 is supplied to the collection tank 210 by the fluid circulation unit 220 with being dissolved in a fluid, and then carbon dioxide is separated from the fluid by the separator 230 and collected in the collection tank 210, and thus the carbon dioxide in the shield case 100 is stably bypassed to be collected in the collection tank 210.

Specifically, since the fluid is circulated through the fluid supply pipe 221 and the fluid discharge pipe 222 by the negative pressure of the circulation pump 223, the carbon dioxide in the shield case 100 can be easily supplied to the collection tank 210. Further, the fluid is heated by the heater 230, and thus carbon dioxide is separated from the fluid, and the separated carbon dioxide is collected in the collection tank 210.

Further, since the circulation pump 223 is operated by the leak detection sensor 224 for detecting the leakage of carbon dioxide, it is operated only when carbon dioxide leaks from the connection part 2, thus reducing the consumption of energy.

Further, since the collection tank 210 is provided with the discharge unit 240, carbon dioxide is discharged from the collection tank 210 to the air, and thus the internal pressure of the collection tank can be controlled.

For example, when the discharge unit 240 is composed of the concentration sensor 241 and the discharge valve 242 opened and closed by the control signal of the concentration sensor 241, the pressure of carbon oxide in the collection tank 210 is electrically controlled. Unlike this, when the discharge unit 240 is composed of only the relief valve, the pressure of carbon oxide in the collection tank 210 is only mechanically controlled.

Moreover, since the collection tank 210 is covered by the secondary collection tank 250, the carbon dioxide discharged through the discharge unit 240 does not leak into the air.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for processing leaking carbon dioxide, which is provided to a transfer line composed of pipes continuously connected from a carbon dioxide generation facility to a carbon dioxide reservoir to process the leakage of carbon dioxide, comprising:

a box-shaped shield case provided to cover a connection part of the pipes constituting the transfer line to prevent carbon dioxide leaking from the connection part from diffusing; and a bypasser bypassing the carbon dioxide into the shield case to the outside of the shield and storing this carbon dioxide wherein the bypasser comprises:

a collection tank connected with the shield case to collect the carbon dioxide discharged from the shield case;

a fluid circulation unit connecting the collection tank with the shield case and circulating a fluid between the collection tank and the shield case to supply the carbon dioxide stored in the shield case to the collection tank with the carbon dioxide dissolved in a fluid; and a separator separating carbon dioxide from the fluid supplied to the collection tank.

2. The apparatus of claim 1, wherein the fluid circulation unit comprises:

a fluid supply pipe connecting the collection tank with the shield case to supply the fluid from the collection tank to the shield case;

a fluid discharge pipe connecting the collection tank with the shield case to discharge the fluid from the shield case to the collection tank; and a circulation pump providing negative pressure to the fluid supply pipe or the fluid discharge pipe to circulate the fluid.

3. The apparatus of claim 2, wherein the fluid circulation unit further comprises a leak detection sensor installed in the shield case to detect the concentration of carbon dioxide in the shield case and operate the circulation pump depending on the detected concentration of carbon dioxide.

4. The apparatus of claim 1, wherein the separator is a heater installed in the collection tank to heat the fluid supplied to the collection tank and separate carbon dioxide dissolved in the fluid.

5. The apparatus of claim 1, wherein the bypasser further comprises a discharge unit discharging the carbon dioxide separated from the fluid and collected in the collection tank.

6. The apparatus of claim 5, wherein the discharge unit comprises:

a concentration sensor detecting the concentration of carbon dioxide in the collection tank and generating a control signal when the detected concentration reaches a set value; and a discharge valve opening and closing the collection tank according to the control signal of the concentration sensor to discharge carbon dioxide to the outside of the collection tank.

7. The apparatus of claim 5, wherein the discharge unit comprises a relief valve opening and closing the collection tank according to an increase in internal pressure of the collection tank to discharge carbon dioxide to the outside of the collection tank.

8. The apparatus of claim 5, wherein the bypasser further comprises a secondary collection tank covering the collection tank to collect the carbon dioxide discharged through the discharge unit.

9. A method of processing carbon dioxide leaking from a transfer line composed of pipes connected by a connection part, comprising the steps of:

covering the connection part to prevent the diffusion of carbon dioxide leaking from the connection part; and bypassing the carbon dioxide and storing this carbon dioxide in a collection tank with the collection tank being spaced apart from the connection part wherein the step of bypassing carbon dioxide comprises the steps of: detecting carbon dioxide;

supplying a fluid to the detected carbon dioxide and circulating this fluid to bypass the carbon dioxide dissolved in the fluid; and separating carbon dioxide from the carbon dioxide-dissolved fluid.

10. The method of claim 9, wherein, in the step of separating the carbon dioxide, the carbon dioxide is separated from the fluid by heating the fluid.

* * * * *